US006763537B1

(12) United States Patent
Crear

(10) Patent No.: US 6,763,537 B1
(45) Date of Patent: Jul. 20, 2004

(54) PRAYER PILLOW

(76) Inventor: Williadean Crear, 36 11th Ave. SW., Birmingham, AL (US) 35211

( * ) Notice: Subject to any disclaimer, the term of this patent is extended or adjusted under 35 U.S.C. 154(b) by 0 days.

(21) Appl. No.: 10/228,519

(22) Filed: Aug. 27, 2002

(51) Int. Cl.[7] ..... A47C 9/00
(52) U.S. Cl. ..... 5/636; 5/639; 5/632
(58) Field of Search ..... 5/632, 636, 639, 5/648, 651

(56) References Cited

U.S. PATENT DOCUMENTS

| | | | | | |
|---|---|---|---|---|---|
| 830,103 | A | | 9/1906 | Rundell | |
| 4,736,477 | A | | 4/1988 | Moore | |
| 4,768,245 | A | | 9/1988 | Dutton | |
| 5,271,114 | A | | 12/1993 | Kjersem | |
| 5,421,637 | A | * | 6/1995 | Lemburg | 297/188.01 |
| 5,652,983 | A | | 8/1997 | Kraemer | |
| 5,823,574 | A | | 10/1998 | Sullins et al. | |
| 6,076,211 | A | * | 6/2000 | Chatman | 5/653 |

* cited by examiner

*Primary Examiner*—Teri Pham Luu
*Assistant Examiner*—Fredrick Conley
(74) *Attorney, Agent, or Firm*—Kenneth M. Bush; Bush IP Law Group, LLC

(57) ABSTRACT

A portable prayer pillow designed to be kneeled upon by an individual during prayer and worship, wherein the pillow includes items necessary for keeping a prayer journal. In a preferred embodiment, the pillow comprises a first pocket having a plurality of blank paper or cloth strips on which information can be written and a second pocket for receiving and storing the strips having information written thereon. In use, for example, the individual can remove a blank strip from the first pocket, write a prayer request on the strip, and place the strip into the second pocket. When the prayer is answered, the individual can retrieve the strip from the second pocket, make an appropriate notation thereon, and place the updated strip back into the second pocket, or the individual can take a second blank strip from the first pocket, write a praise report thereon, and place the second strip in the second pocket. In an alternate embodiment having a third pocket, the updated or second strip can be placed in the third pocket. Thus, a prayer journal that can be reviewed periodically is maintained.

3 Claims, 3 Drawing Sheets

PRAYER PILLOW

FIELD OF THE INVENTION

The present invention relates to pillows, and more particularly, to a pillow designed to facilitate prayer and worship.

BACKGROUND OF THE INVENTION

During prayer and worship, it is common for an individual to kneel out of respect for God. Indeed, some houses of worship include padded knee supports attached to pews that are kneeled upon by worshipers during prayer and worship. However, many houses of worship do not have such knee supports and many worshipers kneel before God in places other than houses of worship. In addition, many worshipers keep prayer journals in which they record prayer requests, praise reports, and the like.

The present invention addresses an unmet need by providing a portable prayer pillow that is specifically designed to facilitate prayer and worship.

SUMMARY OF THE INVENTION

The present invention facilitates prayer and worship by providing a portable prayer pillow designed to be kneeled upon by an individual during prayer and worship, wherein the pillow includes items necessary for keeping a prayer journal. In a preferred embodiment, the pillow comprises a first pocket having a plurality of blank paper or cloth strips on which information can be written and a second pocket for receiving and storing the strips having information written thereon. In use, for example, the individual can remove a blank strip from the first pocket, write a prayer request on the strip, and place the strip into the second pocket. When the prayer is answered, the individual can retrieve the strip from the second pocket, make an appropriate notation thereon, and place the updated strip back into the second pocket, or the individual can take a second blank strip from the first pocket, write a praise report thereon, and place the second strip in the second pocket. In an alternate embodiment having a third pocket, the updated or second strip can be placed in the third pocket. Thus, a prayer journal that can be reviewed periodically is maintained.

These and other features of the invention will become apparent from the following detailed description of the preferred embodiment of the invention.

DETAILED DESCRIPTION OF THE INVENTION

Figure 1:
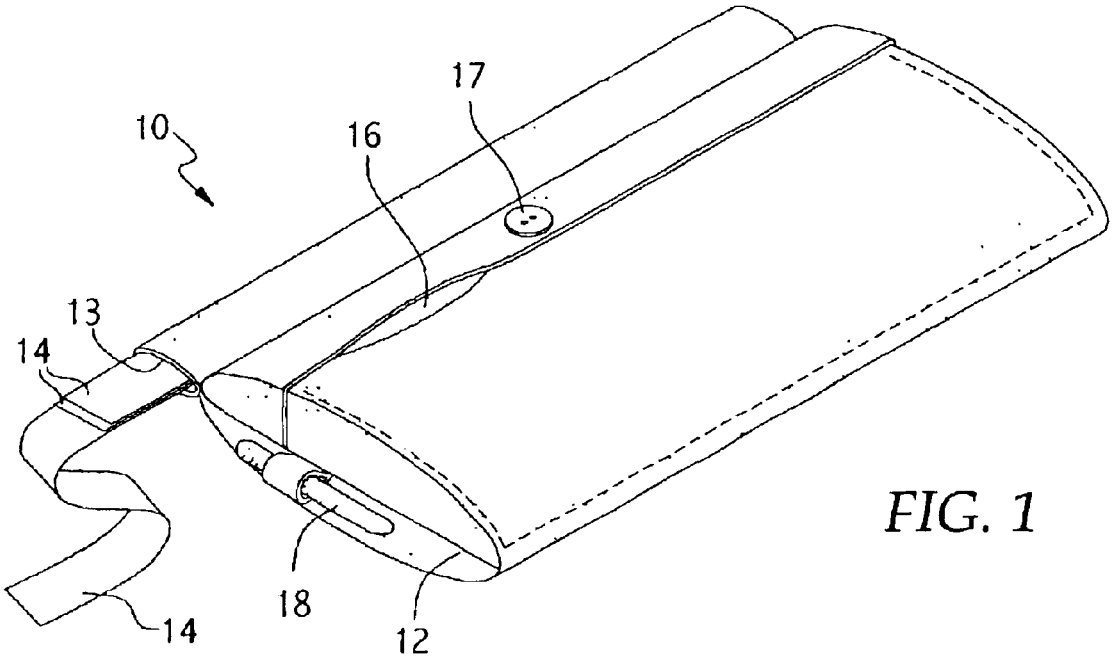
FIG. 1 is a perspective view of a preferred embodiment of the invention.
Figure 2:
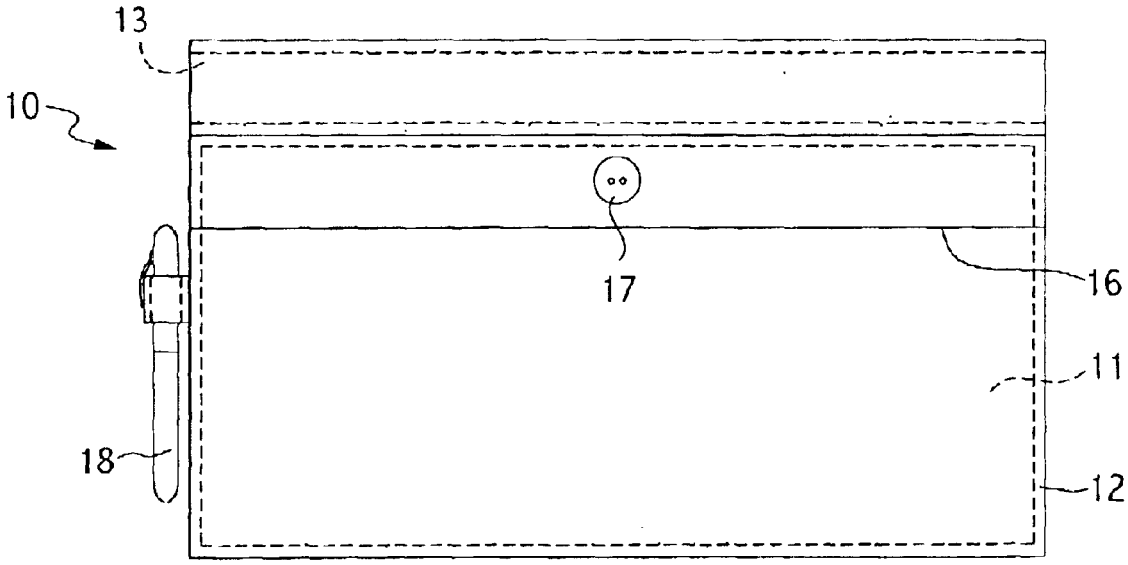
FIG. 2 is front elevational view of the embodiment of FIG. 1.
Figure 3:
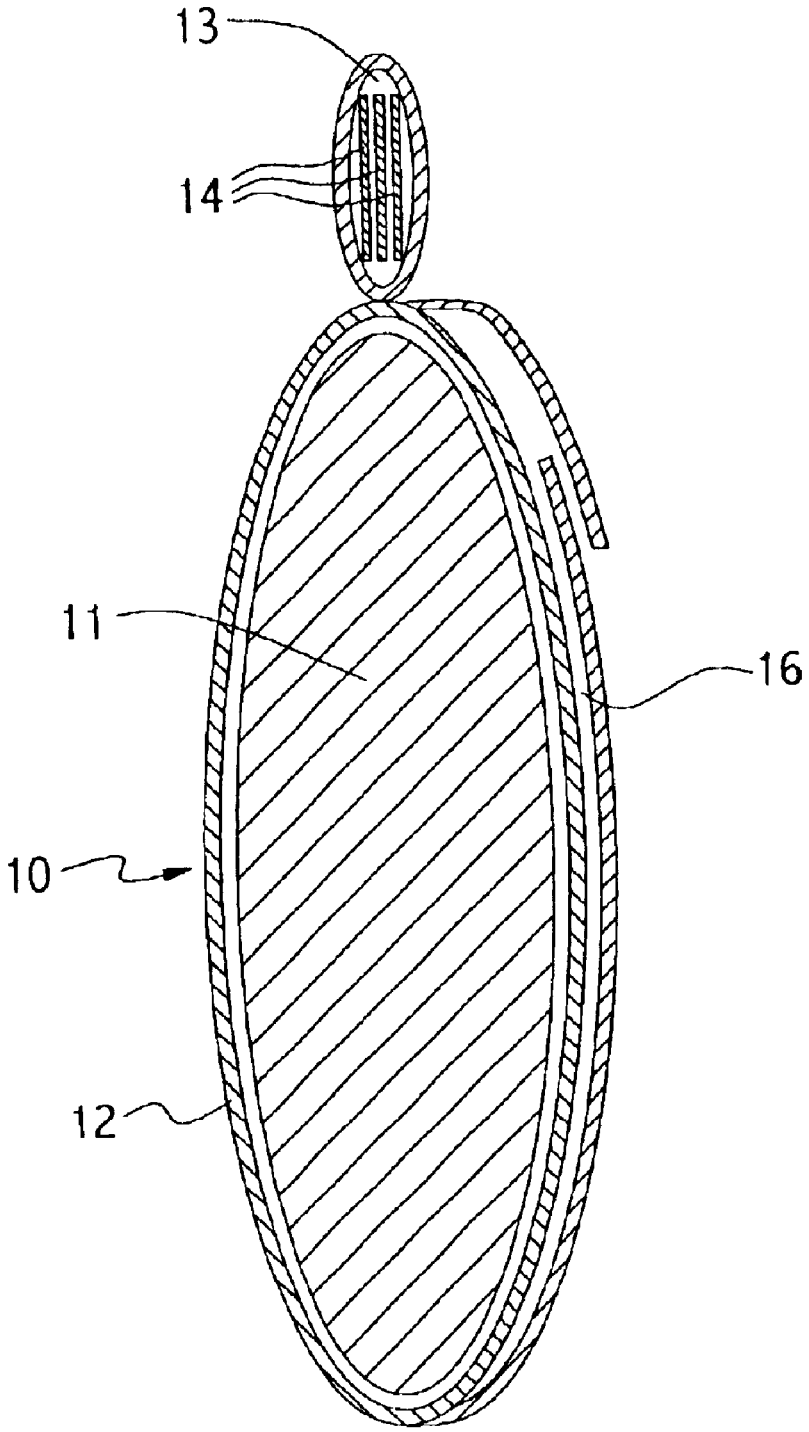
FIG. 3 is a sectional view of the embodiment of FIG. 1.

The present invention is a portable prayer pillow designed to be kneeled upon by an individual during prayer and worship, wherein the pillow includes items necessary for keeping a prayer journal. In a preferred embodiment shown in FIGS. 1–3, the pillow 10 preferably comprises a cushion 11 enclosed within a flexible cover 12. The cushion 11 can comprise any appropriate material capable of comfortably supporting an individual kneeling on the pillow, such as natural or synthetic fibers, foam, or gel. The flexible cover 12 can comprise any appropriate material capable of enclosing the cushion without interfering with the cushioning effect, such as natural or synthetic fabrics.

The pillow 10 comprises a first pocket 13 having a plurality of blank writing materials 14 on which information (e.g. prayer requests, praise reports, praises, etc.) can be written and a second pocket 16 for receiving and storing the materials 14 having information written thereon. The second pocket 16 is preferably located in that portion of the pillow that is kneeled upon. The writing materials 14 can be any medium on which information can be recorded, such as paper or cloth strips. The pockets 13, 16 are preferably closeable via a button, zipper, hook and loop fastener, or other appropriate fastening means 17. The pillow 10 preferably further comprises a marking device 18, such as a pen or pencil, for recording information on the writing materials 14.

In use, for example, an individual can remove a blank strip 14 from the first pocket 13, write a prayer request and date thereon, and place the strip in the second pocket 16. The individual can then kneel upon the pillow during prayer and worship. When the prayer is answered, the individual can retrieve the strip 14 from the second pocket 16, make an appropriate notation thereon (e.g. the date and manner that the prayer was answered), and return the updated strip 14 to the second pocket 16, or the individual can take a second blank strip 14 from the first pocket 13, write a praise report thereon, and place the second strip 14 in the second pocket 16. Thus, a prayer journal that can be reviewed periodically is maintained.

Figure 4:
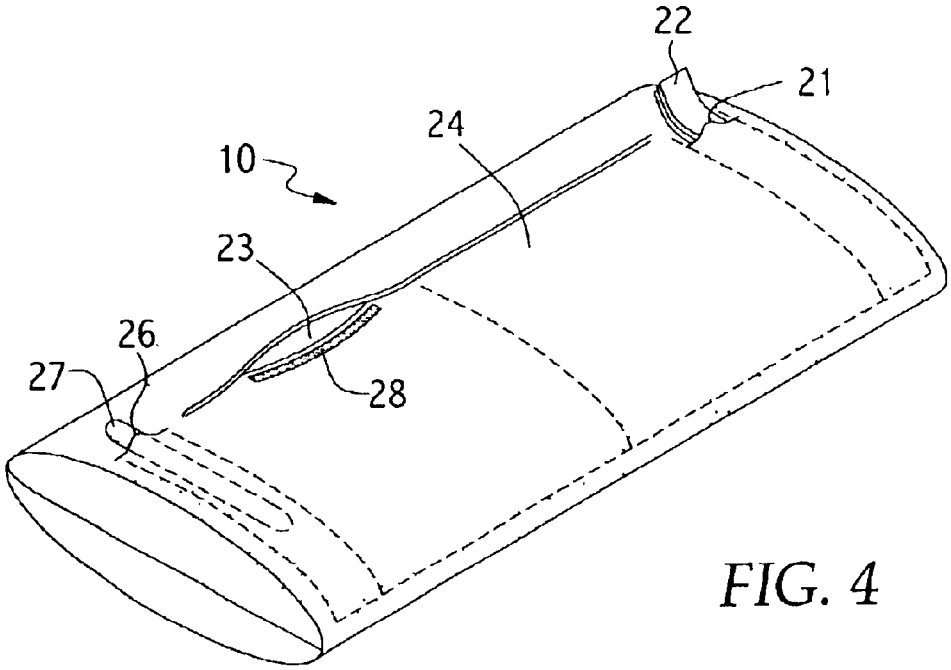
FIG. 4 is a perspective view of an alternate embodiment of the invention.
Figure 5:
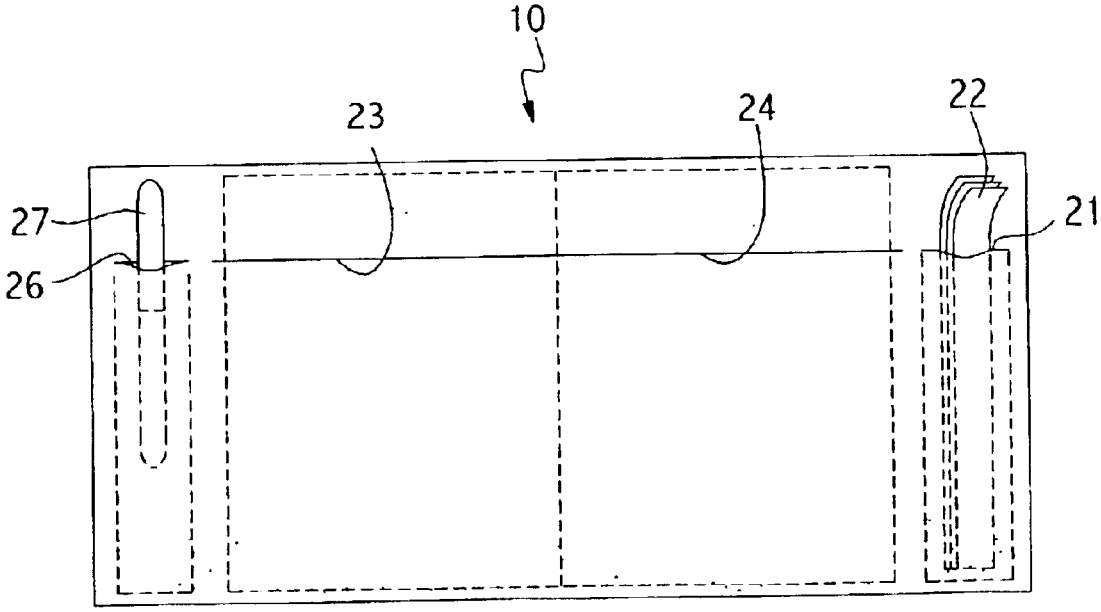
FIG. 5 is a front elevational view of the embodiment of FIG. 4.

In another embodiment shown in FIGS. 4–5, the prayer pillow 10 comprises a first pocket 21 having a plurality of blank writing materials 22, second 23 and third 24 pockets for receiving and storing the materials 22 having information written thereon, and a fourth pocket 26 for storing a marking device 27. The second and third pockets 23, 24 are preferably located in that portion of the pillow that is kneeled upon. Again, the pockets are preferably closeable via a button, zipper, hook and loop fastener, or other appropriate fastening means 28. In use, for example, an individual can write a prayer request on a blank strip 22 and place the strip in the second pocket 23. The individual can then kneel upon the pillow in prayer and worship. When the prayer is answered, the individual can retrieve the strip 22 from the second pocket 23, make an appropriate notation thereon, and place the updated strip 22 in the third pocket 24, thereby maintaining a prayer journal that can be reviewed periodically.

While the invention has been shown and described in some detail with reference to specific exemplary embodiments, there is no intention that the invention be limited to such detail. On the contrary, the invention is intended to include any alternative or equivalent embodiments that fall within the spirit and scope of the invention as described above and as recited in the appended claims.

What is claimed is:

1. A method for using a portable prayer pillow, comprising the steps of:

removing a blank writing material from a first pocket formed on a pillow;

writing information on said writing material;

placing said writing material having said information written thereon in a second pocket formed on said pillow; and kneeling upon said pillow.

2. A method according to claim 1, further comprising the steps of:

retrieving said writing material having said information written thereon from said second pocket;

recording updated information on said writing material; and returning said writing material having said updated information recorded thereon to said second pocket.

3. A method according to claim 1, further comprising the steps of:

retrieving said writing material having said information written thereon from said second pocket;

recording updated information on said writing material; and inserting said writing material having said updated information recorded thereon in a third pocket.

* * * * *